United States Patent [19]

Nguyen

[11] Patent Number: 5,027,913

[45] Date of Patent: Jul. 2, 1991

[54] INSERT ATTACK ANGLE FOR ROLLER CONE ROCK BITS

[75] Inventor: Quan V. Nguyen, Spring, Tex.

[73] Assignee: Smith International, Inc., Houston, Tex.

[21] Appl. No.: 507,827

[22] Filed: Apr. 12, 1990

[51] Int. Cl.[5] ..... E21B 10/16

[52] U.S. Cl. ..... 175/336; 175/341; 175/353; 175/410

[58] Field of Search ..... 175/336, 341, 350, 351, 175/353, 355, 370, 401, 410

[56] References Cited

U.S. PATENT DOCUMENTS

| | | | |
|---|---|---|---|
| 2,038,386 | 4/1936 | Scott et al. | 175/353 |
| 3,385,385 | 5/1968 | Kucera et al. | 175/378 X |
| 3,743,038 | 7/1973 | Bennett | 175/341 |
| 3,763,942 | 10/1973 | Levitt | 175/354 |
| 4,108,260 | 8/1978 | Bozarth | 175/374 |
| 4,187,922 | 2/1980 | Phelps | 175/378 X |
| 4,415,208 | 11/1983 | Goyarts | 299/91 |
| 4,641,718 | 2/1987 | Bengtsson | 175/353 X |
| 4,751,972 | 6/1988 | Jones et al. | 175/336 X |

*Primary Examiner*—William P. Neuder
*Attorney, Agent, or Firm*—Robert G. Upton

[57] ABSTRACT

The inserts for a roller cone of a multiple cone rock bit are positioned or angled in the cone to attack an earthen formation such that the inserts are subjected to more compressive forces and the formation is subjected to more shear forces as the roller cutters roll over the bottom of the formation.

4 Claims, 3 Drawing Sheets

INSERT ATTACK ANGLE FOR ROLLER CONE ROCK BITS

BACKGROUND OF THE INVENTION

I. Field of the Invention

This invention relates to roller cone rock bits with tungsten carbide inserts inserted within insert holes formed within the body of the roller cones.

More particularly this invention relates to the attack angle of each of the tungsten carbide inserts retained within a cone. Each of the inserts have an attack angle with respect to a borehole formation that assures that the insert is primarily in a compressive mode upon initial contact with the formation, and the insert introduces more scraping and shearing to the earthen formation.

II. Description of the Prior Art

Most of the roller cone prior art that teaches the use of tungsten carbide inserts pressed into roller cones have the center line of the tungsten carbide inserts intersecting an axis of the cone. Hence the inserts are generally 90° with respect to a face of the frusto conical cone with the center line of the insert passing through the axial center line of the cone and rock bit journal.

U.S. Pat. No. 3,743,038 teaches an improved drill bit tooth of a milled tooth rotary cone bit having a leading tooth face, i.e. the face first contacting the formation being cut substantially parallel with an axis of rotation of the drill bit cone. The trailing face of the milled tooth is convexly shaped to act as a fulcrum. This tooth configuration allows the tooth to get under and lift a chip from the formation being cut rather than sliding it to the side. The leading face of each of the milled teeth intersects an axial center line of the cone.

The present invention orients each of the tungsten carbide inserts such that the inserts have an attack angle with respect to a formation. The center line of the insert does not intersect the axial center line of each of the cones.

U.S. Pat. No. 3,763,942 teaches a large mechanically driven auger or boring head designed especially for horizontal rock and earth drilling of mines or tunnels. The boring head defines a circular ring of circumferentially spaced tool bits or teeth. The cutting teeth on the ring of the body of the bit project radially outwardly from the peripheral surface of the ring and are tilted forwardly in the direction of rotation of the auger head. The cutting teeth on the body of the bit project forwardly and tilt toward the direction of rotation of the cutting head and are also tilted backwardly to present the tip end of each tooth in a straight forward direction to the surface in which it is cutting. In addition the teeth are staggered so that successive teeth will not have the same cutting track.

The present invention differs in that it is for a rotary cone rock bit wherein each of the tungsten carbide inserts are angled such that they are positioned approximately axially relative to an earthen formation at initial contact. Each of the inserts therefore, are in a more compressive mode rather than in shear as the insert first contacts the bottom of a borehole.

U.S. Pat. No. 4,415,208 is yet another mining bit having individual cutters mounted to a mechanically driven ring for the tunnel cutter. This patent deals with a means of mounting the insert. The cutter bit assembly has an elongated cutter element, a bit holder, a bit block and locking means for removably affixing the bit holder to the bit block. The bit holder has a tapered locking lip and a tapered surface wherein a resulting cutting force provides a locking action against the taper.

This patent, like the foregoing patent, differs from the present invention in that each of the cutter orientation is not in a true compressive mode as the cutter attacks a formation. The present invention describes a roller cone bit wherein the cones roll on a formation bottom with a heavy weight driving the cones into the formation, each of the inserts being angled to assure that the inserts are in a compressive mode upon first contact rather than a shear mode during the cutting operation.

U.S. Pat. No. 4,108,260 describes roller cone rock bits with specially shaped inserts. The insert to the type used for cutter of teeth rock bits used in drilling soft and medium formations of the earth are generally chisel shaped with the flanks converging to a crest. The flanks however of the present invention are asymmetrical with respect to each other. The leading flank is scoop-shaped and the trailing flank is rounded outwardly. The center line of each of the inserts pass through an axial center line of the roller cone.

As stated before, the present invention has each of the center line of the inserts that do not intersect the axial center line of the roller cone, each of the inserts being angled to insure that the insert is primarily in compression upon initial contact with the formation. The foregoing patent, while it describes a scoop-shaped insert, each of the inserts have an orientation that is primarily 90° to a surface of the roller cones, the center line of the asymmetrical inserts intersecting the axial center line of the cone.

SUMMARY OF THE INVENTION

It is an object of this invention to provide a means to assure that each of the inserts mounted within a roller cone is oriented such that the insert is in contact with an earth formation under compressive loads.

More specifically it is an object of the present invention to provide an angled insert orientation in the roller cone such that the insert center line does not intersect the axial center line of the cone. Each insert is oriented to attack an earthen formation with less shear/bending modes within the insert and more scraping and shearing at the formation upon initial contact thereby more efficiently cutting the rock formation.

A rotary cone rock bit consists of a rock bit body having cones rotatively secured to journal bearings extending from one or more legs attached to the body. The rotary cone of the rock bit has multiple cutter inserts generally equidistantly spaced apart and arranged in circumferential rows along an axis of the cone. An attack angle of each insert in each of the rows is directed toward the direction of rotation of the cone whereby an axis of each insert is offset from a radial orientation defined between the cone axis and an outside surface formed by the cone body. Each insert therefore is subjected to maximum compressive loads and minimum shear loads at initial contact with an earthen formation when the rotary cone rock bit is in operation.

An advantage then of the present invention over the prior art is the angular orientation of inserts embedded in a rotary cone, each of the inserts having an attack angle that initially subjects each insert to compressive modes resulting in less bending and hence breakage of the insert during initial contact of the insert with an earthen formation. The aggressive attack angle of the inserts result in more shearing, scraping and peeling of the formation during operation of a rotary cone rock bit in a borehole.

It is another advantage of the present invention over the prior art in that each of the angled inserts are additionally directed to be substantially aligned with an axis of the rock bit body to assure compressive loads on the inserts resulting from the weight on the bit as the bit works in a borehole.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
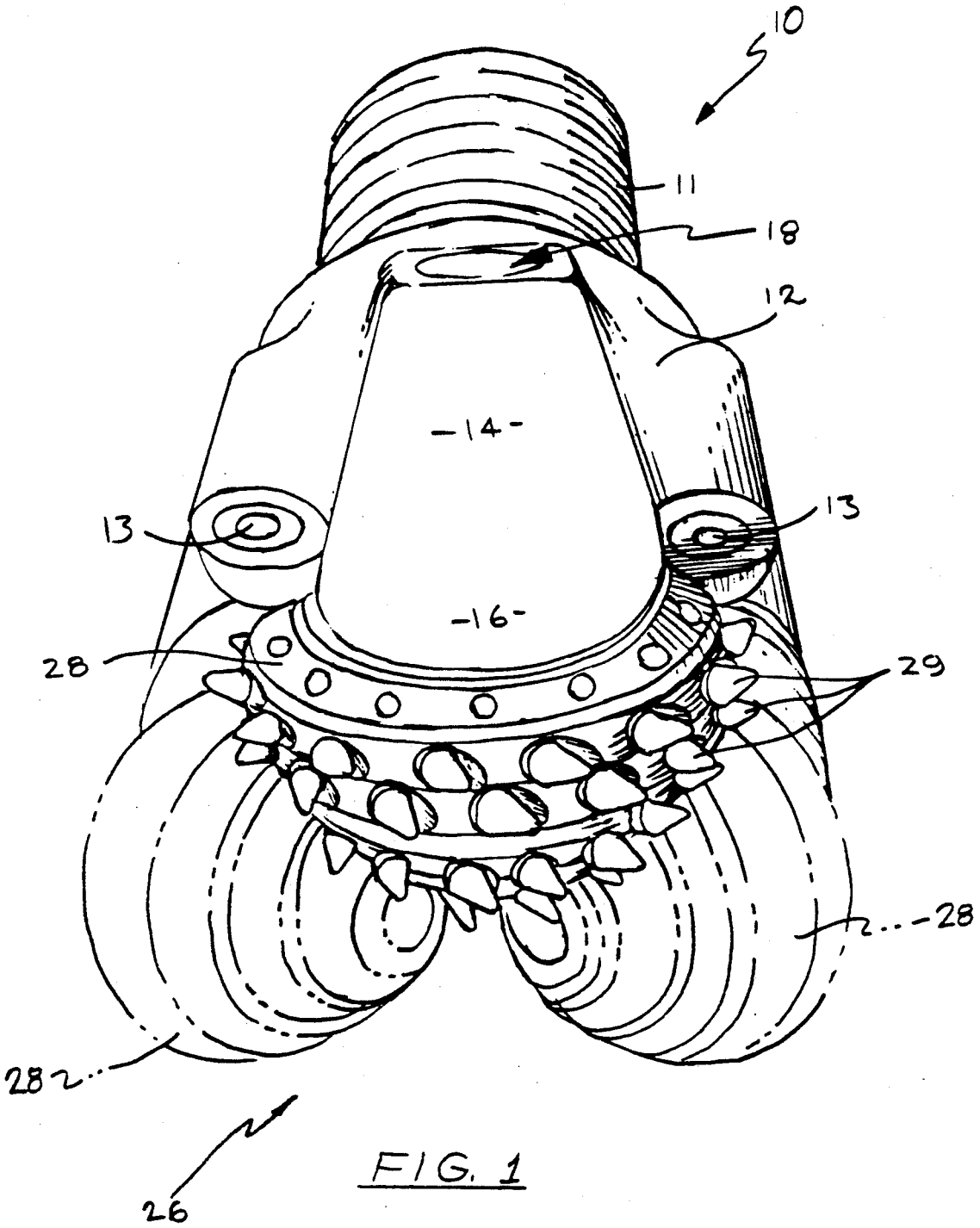
FIG. 1 is a perspective view partially in phantom of a preferred embodiment of the present invention illustrating the angled inserts in a rotary cone.
Figure 6:
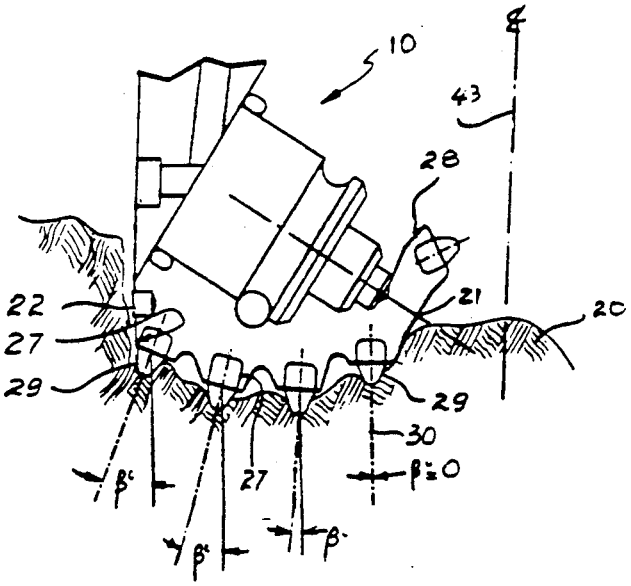
FIG. 6 is a partially broken away cross-sectional view taken through 6—6 of FIG. 3 of a rotary cone attached to a journal in an earthen formation the orientation of each of the inserts being relatively aligned with an axial center line of a rock bit.

With reference now to FIG. 1, the rotary cone rock bit generally designated as 10 consists of a rock bit body 12, pin end 11 and cutting end generally designated as 26. Each cone 28 associated with cutting end 26 is rotatably attached to a journal bearing extending from a leg 14 that terminates in a shirttail portion 16. Each of the cones 28, for example, has a multiplicity of substantially equally spaced inserts 29 interference fitted within insert holes 27 formed in the cone body 28 (FIG. 6). A lubricant reservoir generally designated as 18 is provided in each of the legs 14 to supply lubricant to bearing surfaces formed between the rotary cones and their respective journals. Three or more nozzles 13 communicate with a chamber formed within the bit body 12 (not shown). The chamber receives drilling fluid or "mud" through a pin end 11, the fluid then is directed out through the nozzles 13 during bit operation.

Figure 2:
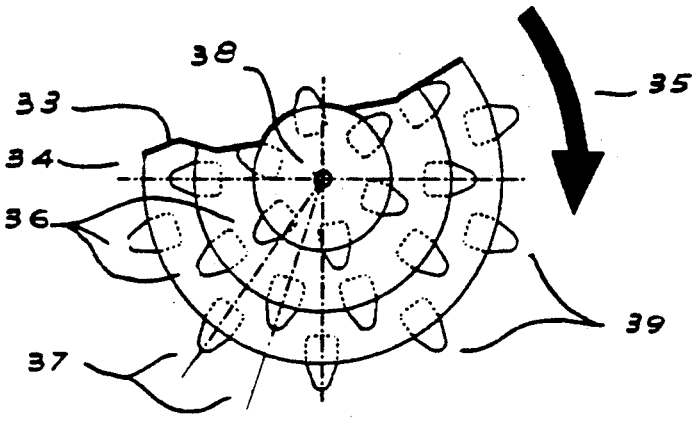
FIG. 2 PRIOR ART
FIG. 2 is a view of the prior art illustrating a typical prior art cone with tungsten carbide inserts having their insert axis intersecting an axial center line of the cone.

Turning now to the prior art FIG. 2, a rotary cone 34 has embedded within the cone body, a multiplicity of, for example, tungsten carbide inserts 36. The inserts 36 have, for example, conical cutting ends 39. An axis 37 of each of the inserts 36 passes through a cone axis 38. Each of the inserts then are about normal to a surface 33 of the cone 34. The rotation of the cone typically is in the direction 35, however it should be noted that with the orientation of the inserts in the cone 34 normal to a surface of the cone 33 it wouldn't matter which direction the cone was rotated in.

Figure 3:
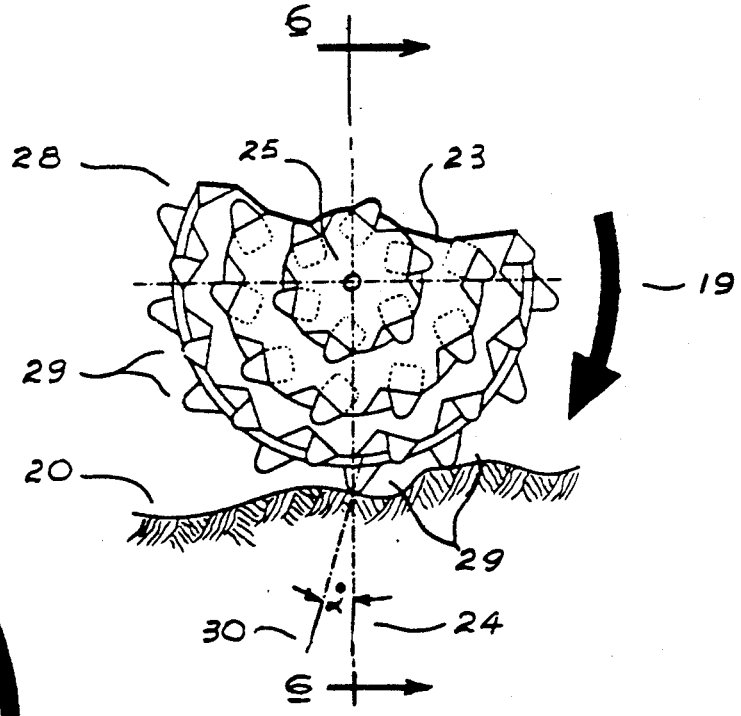
FIG. 3 is a partially cutaway view illustrating a rotary cone of the present invention with the inserts having their axis not aligned with a center line of the cone. Each insert is angled with respect to an earthen formation.

With reference now to FIG. 3, the preferred embodiment of the invention, cone 28 is shown in contact with an earthen formation 20. Each of the inserts 29 interference fitted within insert retention hole 27 (FIG. 6) is illustrated with an attack angle represented as $\alpha$. Angle $\alpha$ is defined between an axis 30 of the insert 29 and a radial line 24 defined between an axis 25 of the cone through a point at the intersection of the axis 30 and insert profile. This angulation $\alpha$ may be between 0° and 45°. The cone rotation 19 subjects each of the inserts 29 oriented in the direction of rotation of the cone is subjected to a compressive load as the inserts 29 initially contact the earthen formation 20.

Figure 4:
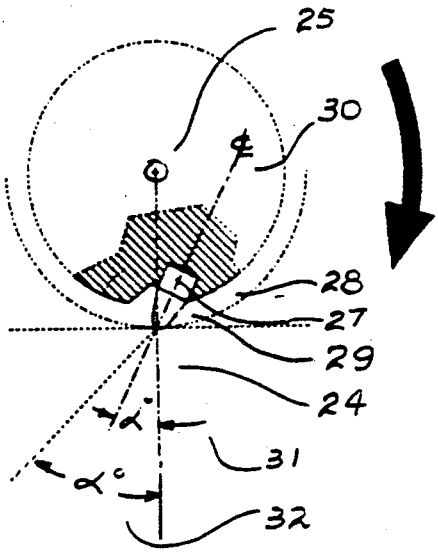
FIG. 4 is a schematic of a rotary cone with a single angled insert contacting a horizontal surface describing a $\alpha$ angle with respect to a radial plane intersecting an axis of the cone.

The schematic of FIG. 4 illustrates a single angled insert 29. The $\alpha$ attack angle is defined between the axis 30 of the insert 29 and a radial line or plane 24 which is defined between the axis 25 of the cone 28 and through a point at the intersection of the axis 30 of the insert and the insert profile. In the example shown, this angle is 30° (angle 31). The maximum angulation for $\alpha$ is shown by $\alpha$ angle 32 and it is 45°. The amount of angulation for $\alpha$ in a particular row depends on the equidistant spacing from insert to insert in a row.

Figures 5A, 5B:
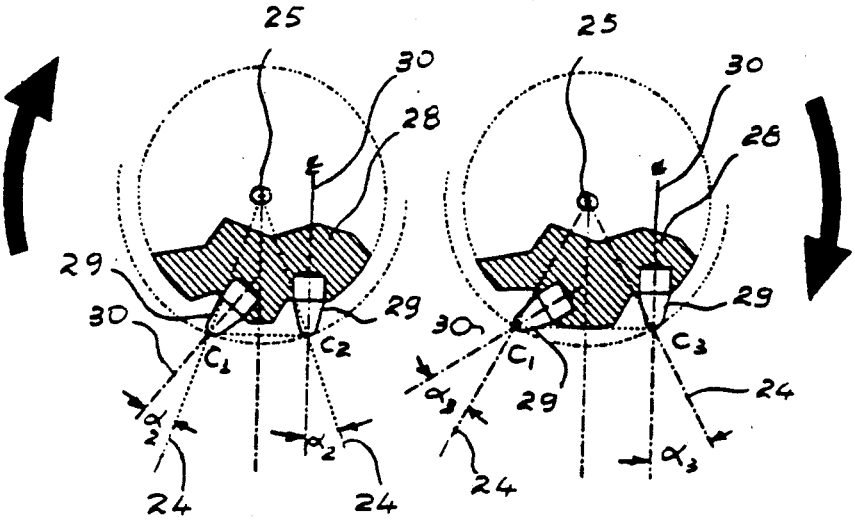
FIGS. 5*a* and 5*b* depict schematics illustrating inserts and their $\alpha$ angles with respect to circumferential spacing, one insert to another.

FIGS. 5*a* and 5*b* illustrate schematically the preferred attack angulation from insert to insert. For example, if the insert C1 is spaced as shown from C1 to the insert C3, the $\alpha$ angle 3 is greater than $\alpha$ angle 2 because of the further spacing from C1 to C3 as compared to C1 to C2. If the spacing between inserts in a single circumferential row is close then the $\alpha$ angle is less between each of the equidistantly spaced inserts in that particular row. In another row, if the inserts are spaced further apart around that circumferential row then the $\alpha$ angle is greater as illustrated by $\alpha$ angle 3. The attack angle is greater in $\alpha$ angle 3 than $\alpha$ angle 2 because C3 is further from C1 than C2 is from C1.

With reference to FIG. 6, the orientation of $\beta$ angle is shown in four separate circumferential rows of inserts, for example, the row of inserts 29 nearest the apex 21 of the cone 28 in FIG. 6 illustrates the insert center line 30 exactly parallel with center line 43 of the rock bit 10. The inserts 29 in the row nearest the heel 22 of the rock bit cone 28 are less parallel with center line 43 due to the material limitation of the cone. The insert retention hole 27 is angled to provide enough cone material to securely retain the insert 29 within its insert retention hole 27.

Figure 7:
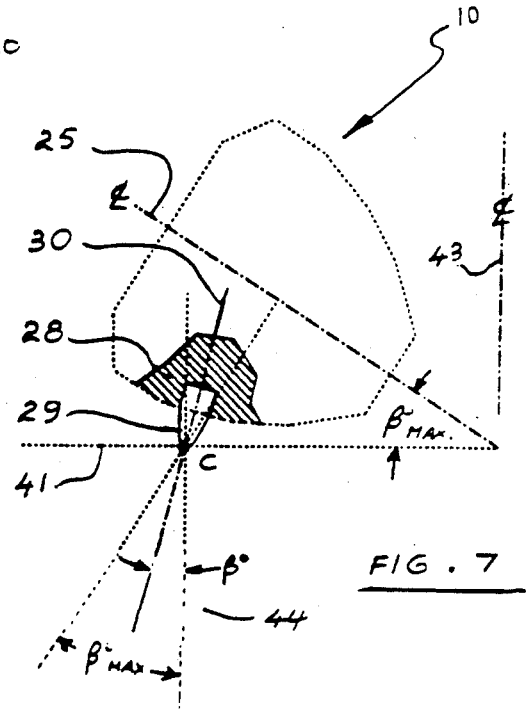
FIG. 7 is illustrating another schematic in the orientation of a single angled insert with respect to a center line of the rock bit. This view shows a $\beta$ angle with respect to an axis of the cone and a horizontal surface.

With reference now to the final schematic of FIG. 7, the inserts 29 are additionally oriented to align the center line of each of the inserts as nearly parallel to the center line 43 of the rock bit 10 as is possible. The $\beta$ angle is defined between an axis 30 of the insert 29 and a line 44 parallel to bit axis 43 through a point at the intersection of axis 30 of the insert 29 and the insert profile. The $\beta$ angle is preferably within the range of $\beta$ max angles defined between the center line 25 of the cone 28 and the line 41 perpendicular to the bit axis 43. However, the angle $\beta$ of the insert 29 defined by the axis 30 of the insert 29 should be as nearly parallel with the center line 43 of the rock bit 10. By aligning each of the inserts as shown in FIG. 7 as nearly parallel as possible to the axis 43 of the rock bit 10, the inserts are positioned so that they are subjected to compressive loads while the rock bit operates in a borehole formation.

By orienting each of the inserts 29 with the attack angle $\alpha$ and with the orientation $\beta$ as illustrated in FIGS. 3 through 7, each of the inserts 29 are subjected to compressive loads rather than shear loads as the cone rotates against a borehole bottom. Moreover, by orienting the inserts as shown in FIGS. 6 and 7 close to parallel with respect to a center line 43 of the rock bit 10, the journals are subjected to more out thrust loading as opposed to in thrust loading.

State of the art inserts as shown in FIG. 2 subject the journals and legs of the rock bits to severe in thrust loads which shortens bearing life leading to premature failure of the bit.

By orienting the inserts through the attack angle $\alpha$ and the orientation $\beta$ less bending loads on each of the inserts occur resulting in far less shearing of the inserts as they work in a borehole. By the foregoing orientation of the inserts, proper cutting action is assured which includes more shear of the material, more scraping action of each of the inserts and less insert breakage during operation of the bit in a borehole.

It would be obvious to utilize inserts other than symmetrical frusto conical inserts. For example, chisel type or asymmetric type inserts common within the rock bit industry may be utilized without departing from the scope of this invention.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described it should be understood that within the scope of the appended claims the invention may be practiced otherwise than as specifically illustrated and described.

What is claimed is:

1. A rotary cone rock bit, the rotary cone of said rock bit having multiple cutter inserts embedded in insert holes formed in a body of the cone, said multiple cutter inserts generally being equidistantly spaced apart and arranged in circumferential rows along an axis of said cone, an attack angle of each insert imbedded in said insert holes in each of said rows being directed toward the direction of rotation of the cone whereby a center line of each insert and a center line of each of said insert holes is offset from a radial plane defined between the cone axis and an outside surface formed by said body, a center line of said insert and a center line of said insert hole formed by said cone is offset from an axis of said rotary cone, an attack angle of each of said inserts imbedded in said insert holes in each of said rows defines a $\alpha$ angle between said axis of the cone and a center line of the inserts, said $\alpha$ attack angle is between 0° and 45°, said $\alpha$ attack angle is greater when the spacing between inserts in a circumferential row is wide apart and less where the spacing between inserts in a circumferential row is closer together, each insert therefore is subjected to maximum compressive loads and minimum shear loads at initial contact with an earthern formation and proper cutting action is assured which includes more shearing of material, and more scraping action of each of the inserts when said rotary cone rock bit is in operation.

2. The invention as set forth in claim 1 further comprising an insert axis orientation of each insert in each of said circumferential rows of inserts is oriented to substantially parallel an axis of said rotary cone rock bit whereby weight on the bit normal to said earthen formation subjects each insert to maximum compression loads and minimum shear loads during operation of the rock bit in said formation.

3. The invention as set forth in claim 2 wherein said insert axis substantially parallel with said rock bit axis is defined as angle $\beta$ formed between an axis of the cone and surface normal to said axis of said rock bit, said insert axis being an angle closest to parallel with said rock bit axis and between said angle defined between said cone axis and said surface normal to said rock bit axis.

4. The invention as set forth in claim 3 wherein and $\alpha$ and angle $\beta$ of each of said equidistantly spaced inserts in said circumferential rows are oriented with said $\alpha$ attack angle and said $\beta$ angle to subject said insert to maximum compressive loads and minimum shear loads while said rotary cone rock bit operates in an earthen formation.

* * * * *